US007381102B2

(12) United States Patent
Camacho

(10) Patent No.: US 7,381,102 B2
(45) Date of Patent: Jun. 3, 2008

(54) SYSTEM FOR ELECTRICALLY CONNECTING AND FIXING AT LEAST ONE CONDUCTOR TO SUPPORT PIECE

(75) Inventor: Gabriel Camacho, Guenange (FR)

(73) Assignee: IDEALEC, Pontarlier (FR)

( * ) Notice: Subject to any disclaimer, the term of this patent is extended or adjusted under 35 U.S.C. 154(b) by 0 days.

(21) Appl. No.: 10/548,897

(22) PCT Filed: Mar. 4, 2004

(86) PCT No.: PCT/FR2004/000512

§ 371 (c)(1),
(2), (4) Date: Jul. 17, 2006

(87) PCT Pub. No.: WO2004/084352

PCT Pub. Date: Sep. 30, 2004

(65) Prior Publication Data

US 2006/0264121 A1 Nov. 23, 2006

(30) Foreign Application Priority Data

Mar. 13, 2003 (FR) ..... 03 03132

(51) Int. Cl.
*H01R 4/30* (2006.01)

(52) U.S. Cl. ..... 439/801; 439/573; 411/546; 411/999

(58) Field of Classification Search ..... 439/101, 439/108, 947, 97, 573, 551, 801; 361/753, 361/758, 742, 818; 411/166, 173, 182, 533, 411/546, 968, 970, 999
See application file for complete search history.

(56) References Cited

U.S. PATENT DOCUMENTS

| | | | | |
|---|---|---|---|---|
| 5,608,611 | A * | 3/1997 | Szudarek et al. | 361/753 |
| 6,377,445 | B1 * | 4/2002 | Davis et al. | 361/683 |
| 7,241,152 | B2 * | 7/2007 | Charrier et al. | 439/97 |
| 2003/0030997 | A1 * | 2/2003 | Mizusaki | 361/758 |
| 2004/0100777 | A1 * | 5/2004 | Lee | 361/758 |
| 2006/0264121 | A1 * | 11/2006 | Camacho | 439/801 |
| 2007/0093144 | A1 * | 4/2007 | Charrier et al. | 439/801 |

FOREIGN PATENT DOCUMENTS

| | | |
|---|---|---|
| EP | 0 993 083 A1 | 4/2000 |
| FR | 2 758 661 | 7/1998 |
| FR | 2 818 019 | 6/2002 |
| FR | 2 818 023 | 6/2002 |

* cited by examiner

*Primary Examiner*—James Harvey
(74) *Attorney, Agent, or Firm*—Harrington & Smith, PC

(57) ABSTRACT

This system for electrically connecting and fastening at least one plate-type electrical conductor onto a support piece provided with a threaded pin designed to be engaged in a corresponding hole of conductor and to cooperate with a nut for screwing conductor onto support piece, is characterized in that an annular spacer of electrically conductive material is joined to conductor on the side of this conductor that is facing the support piece and in that nut is positioned on the other side of conductor, and is joined to spacer by coupling means allowing the rotation of the nut relative to the spacer and a determined course of axial movement for nut relative to this spacer, between a position of assembling distant from the conductor and a position for screwing in which the nut is supported against the conductor, in order to facilitate the positioning and then the screwing of the conductor against the support piece.

9 Claims, 2 Drawing Sheets

SYSTEM FOR ELECTRICALLY CONNECTING AND FIXING AT LEAST ONE CONDUCTOR TO SUPPORT PIECE

FIELD OF THE INVENTION

The present invention concerns a system for electrically connecting and fastening at least one plate-type electrical conductor onto a support piece.

BACKGROUND OF THE INVENTION

More particularly, the invention relates to such systems in which the support piece is provided with a threaded pin designed to be engaged in a corresponding hole of the conductor and to cooperate with a nut for screwing the conductor onto the support piece.

Such connection systems are currently used, for example, in plate or busbar systems to assure the connection of electrical conductors.

One example of such a system is described in document FR-A-2,784,241.

It is also known that generally, these connection systems have a certain number of disadvantages, notably during positioning and screwing of the conductor against the support piece, in places that are difficult to access.

In fact, these connection systems are generally positioned in the bottom of electrical supply cabinets or baskets and are difficult to access by assemblers.

It can therefore happen that this assembler lets go off one or the other of the parts that make up these systems, and that this part is difficult or even impossible to recover.

Thus it can be seen that this is annoying, even dangerous, notably for the electrical integrity of the rest of the cabinet or basket.

SUMMARY OF THE INVENTION

The object of the invention is therefore to resolve these problems.

For this purpose, the subject of the invention is a system for electrically connecting and fastening at least one plate-type electrical conductor onto a support piece provided with a threaded pin designed to be engaged in a corresponding hole of the conductor and to cooperate with a nut for screwing the conductor onto the support piece, characterized in that an annular spacer of an electrically conductive material is joined to the conductor on the side of this conductor that faces the support piece, and in that the nut is positioned on the opposite side of the conductor, and is joined to the spacer by coupling means allowing the rotation of the nut relative to the spacer and a determined course of axial movement of the nut relative to this spacer, between a position of assembling distant from the conductor and a screwing position in which the nut is supported against the conductor, in order to facilitate the positioning and then the screwing of the conductor against the support piece.

According to other characteristics:

- the hole of the conductor has a generally oblong shape in order to facilitate centering it on the threaded pin;
- the means for coupling the nut onto the spacer have the form of a tubular sleeve of the nut designed to extend into the conductor hole and whose free end is provided with stop means designed to cooperate with complementary stop means of the spacer;

- the stop means of the end of the sleeve comprise at least one projecting part and the complementary stop means of the spacer comprise at least one corresponding rim;
- the means for coupling the nut onto the spacer comprise tabs in the form of hooks designed to engage in the corresponding hole of the conductor and to cooperate with the complementary stop means of this spacer;
- the spacer has on its side that faces the conductor means in the shape of a receiving groove for the conductor, allowing a determined course of transverse movement of the spacer and the nut relative to the conductor in order to facilitate its centering on the threaded pin;
- the support piece has a reinforcement piece at the level of the threaded pin;
- the support piece is formed by another conductor;
- the support piece is formed by an electrical component; and
- the support piece is formed by an electrical connection plate.

BRIEF DESCRIPTION OF THE DRAWINGS

The invention will be better understood upon reading the description that follows, given solely by way of example and made in reference to the attached drawings, in which.

DETAILED DESCRIPTION OF THE INVENTION

Figure 1:
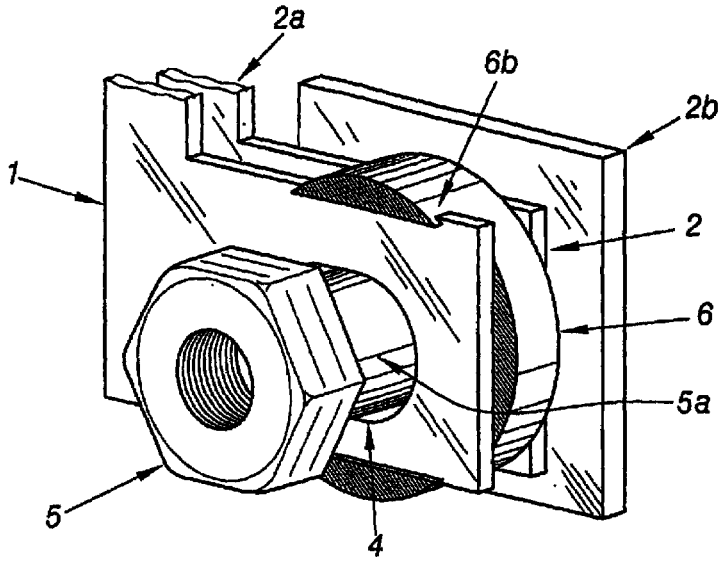
FIG. 1 shows a perspective view of an electrical connection system according to the invention in the position of assembling.

In fact, a system for electrically connecting and fastening at least one plate-type electrical conductor, designated by general reference 1, onto a support piece, designated by general reference 2, is shown in FIGS. 1 to 5.

This support piece 2 has a threaded pin designated by general reference 3, designed to be engaged in a corresponding hole 4 of conductor 1 and to cooperate with a nut 5 for screwing the conductor onto support piece 2.

In fact, different variants of embodiment of the support piece can be envisioned.

Thus, this support piece 2 can be formed by another conductor, an electrical component, a plate or bar for electrical connection, etc.

In the example illustrated in these figures, support piece 2 is formed by another conductor, designated by general reference 2*a* in these figures, provided with a reinforcement piece, designated by general reference 2*b*, at the level of threaded pin 3.

Of course, other embodiments can be envisioned.

Thus it is conceived that by means of such a structure, threaded pin 3 is solidly fastened onto support piece 2.

The connection system according to the invention comprises an annular spacer of electrically conductive material, which is designated by general reference 6 in these figures.

This annular spacer of electrically conductive material 6 is joined to conductor 1, on the side of this conductor that faces support piece 2.

Figure 2:
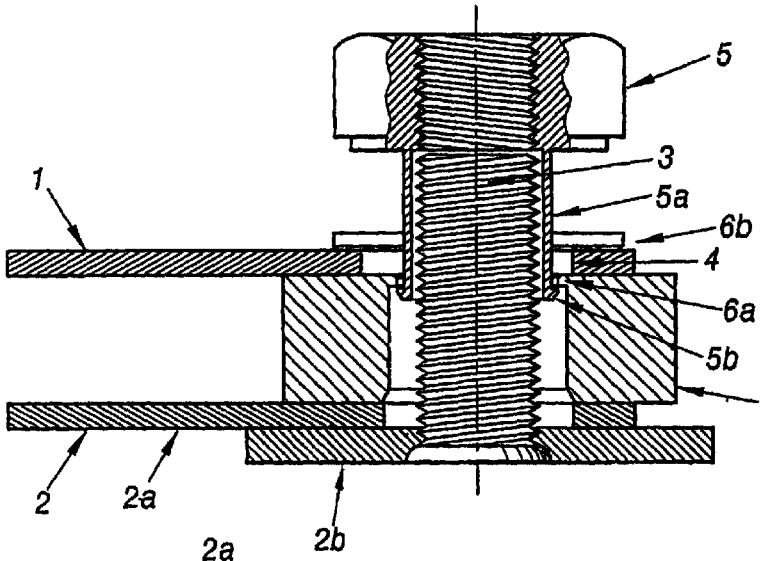
FIG. 2 shows a sectional view of such a system.
Figure 3:
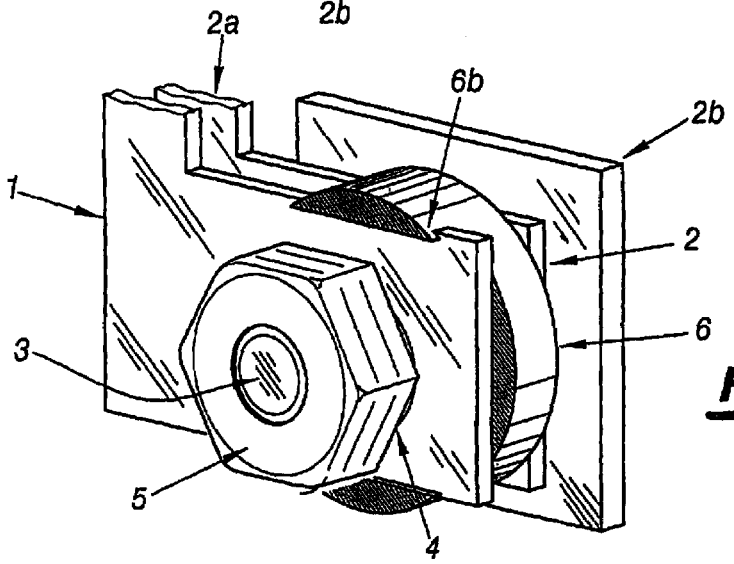
FIG. 3 shows a perspective view of such a system in the position of screwing.
Figure 5:
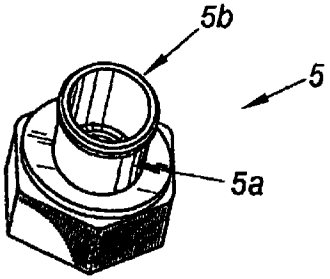
FIGS. 4 and 5 represent perspective views, respectively, of an annular spacer and a nut included in the constitution of such a system.
Figure 4:
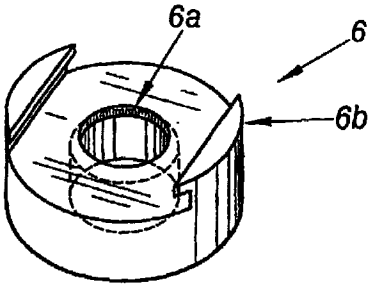

Nut 5 is positioned on the opposite side of conductor 1 and is joined with this spacer 6 by coupling means allowing the rotation of this nut relative to this spacer and a determined course of axial movement of this nut relative to this spacer between a position of assembling distant from the conductor, as is illustrated in FIGS. 1 and 2, and a position for screwing in which the nut is supported against the conductor as illustrated in FIG. 3.

This permits facilitating the positioning and then the screwing of the conductor against the support piece, as will be described in more detail in the following. These means for coupling the nut onto the spacer can, of course, have different forms.

Thus, for example, these means for coupling the nut onto the spacer can have the form of a tubular sleeve 5*a* of the nut whose free end is provided with stop means, for example 5*b*, designed to cooperate with the complementary stop means of the spacer formed, for example, by a rim 6*a* of the spacer.

Thus, the stop means for the end of the sleeve can comprise at least one projecting part designed to be able to cooperate with the corresponding rim of the spacer.

Of course, other embodiments can be envisioned and these means for coupling the nut onto the spacer can, for example, comprise tabs in the form of hooks designed to engage in the corresponding hole of the conductor and to cooperate with the complementary stop means of this spacer, formed, for example, by the rim.

The spacer also comprises, on its side that faces the conductor, means in the form of a receiving groove for the conductor, designated, for example, by general reference 6*b*.

Hole 4 of the conductor has a generally oblong shape in order to facilitate centering it on the threaded pin;

In fact, groove means 6*b* of the spacer and this generally oblong shape of hole 4 of the conductor allow a determined course of transverse movement of spacer 6 and therefore of nut 5 coupled or hooked onto the spacer, relative to conductor 1, in order to facilitate its centering onto threaded pin 3 of the support piece.

This sub-assembly can move slightly relative to the conductor; this permits a compensation for possible lack of alignment between the threaded pin of the support piece and the rest of the system.

Figure 6:
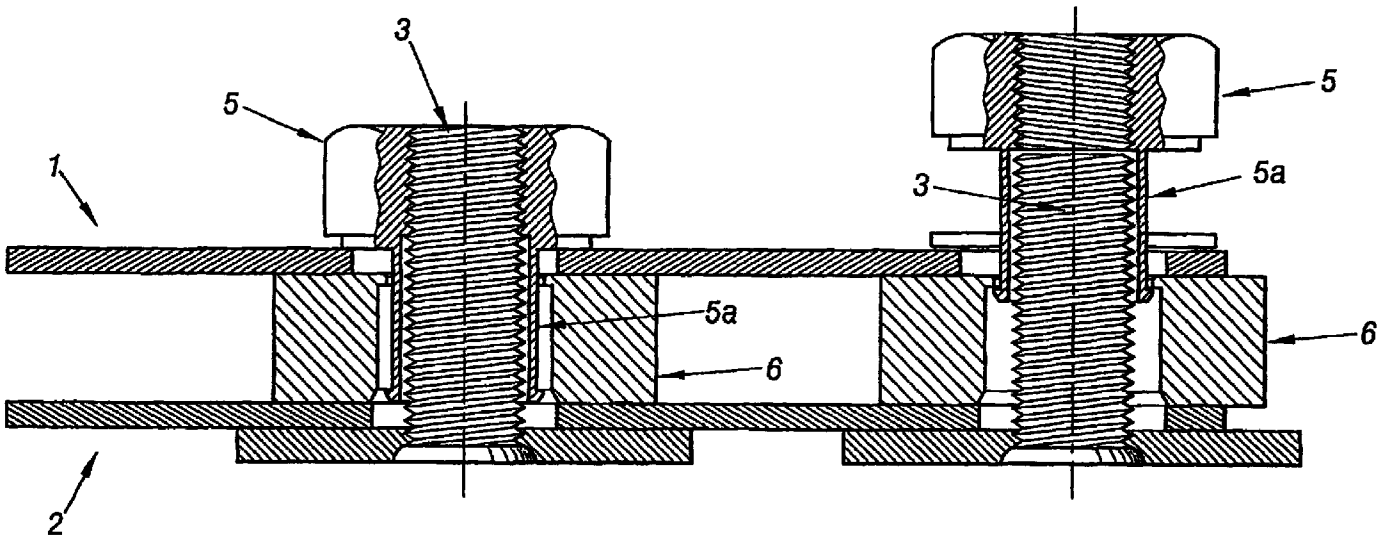
FIG. 6 shows a sectional view of one example of application of such a connection system.

Moreover, the determined course of axial movement of nut 5 relative to spacer 6, between the position of assembling distant from conductor 1 and the position for screwing in which the nut is supported against the conductor permits very simply assembling a conductor with several connection systems of this type onto a support piece, as is illustrated in FIG. 6.

In fact, if conductor 1 has several connection systems as is described previously, permitting coupling it onto several studs 3 of a support piece 2, this determined course of axial movement of the nut relative to the spacer permits, first, positioning conductor 1 against the support piece, without being hindered by the presence of nuts 5, since the nuts are placed in their position of assembling distant from the conductor by being pressed back by the studs, and then next, screwing the latter nuts one after the other.

In FIG. 6, the system on the right is shown in position of assembling, nut 5 being pressed back into the position of assembling by threaded pin 3, while the system on the left is shown in the position for screwing the conductor and the spacer against support piece 2.

An assembler can then screw the nuts independently of one another, without risk of movement or deformation of the conductor.

Of course, other embodiments can also be envisioned.

The invention claimed is:

1. A system for electrically coupling and fastening at least one plate-type electrical conductor onto a support piece provided with a threaded pin designed to be engaged in a corresponding hole of the conductor and to cooperate with a nut for connecting the conductor with the support piece, characterized in that an annular spacer of electrically conductive material is joined to the conductor, on the side of the conductor that faces support piece, and in that this nut is positioned on the opposite side of the conductor, and is joined to the spacer by coupling means allowing the rotation of the nut relative to the spacer, wherein the coupling means provides the nut with a determined limited course of movement of nut relative to the spacer between a first position comprising the nut being assembled with the spacer and being spaced from the conductor and a second position in which the nut is supported against the conductor, and wherein the coupling means facilitates the positioning and then the subsequent fastening of the nut with the threaded pin.

2. The system according to claim 1, further characterized in that the hole of the conductor has a generally oblong shape in order to facilitate mounting the conductor on the threaded pin.

3. The system according to claim 1, further characterized in that the means for the coupling nut onto spacer have the form of a tubular sleeve of the nut designed to extend into the conductor hole and whose free end is provided with stop means designed to cooperate with complementary stop means of the spacer.

4. A system for electrically coupling and fastening at least one plate-type electrical conductor onto a support piece provided with a threaded pin designed to be engaged in a corresponding hole of the conductor and to cooperate with a nut for connecting the conductor with the support piece, characterized in that an annular spacer of electrically conductive material is located on the conductor, on the side of the conductor that faces support piece, and in that the nut is positioned on the opposite side of the conductor, wherein the nut is joined to the spacer by a coupling which allows rotation of the nut relative to the spacer, wherein the coupling provides the nut with a determined limited course of movement of nut relative to the spacer between a first position comprising the nut being assembled with the spacer at a first position on the spacer and a second position at a second position on the spacer against the conductor, wherein the coupling facilitates the positioning and then the subsequent fastening of the nut with the threaded pin, wherein the coupling comprises a tubular sleeve of the nut designed to extend into the conductor hole and whose free end is provided with a stop designed to cooperate with a complementary stop of the spacer, further characterized in that the stop of the end of the sleeve comprises at least one projecting part and in that the complementary stop of the spacer comprises at least one corresponding rim.

5. The system according to claim 1, further characterized in that the support piece is formed by an electrical connection plate.

6. A system for electrically coupling and fastening at least one plate-type electrical conductor onto a support piece provided with a threaded pin designed to be engaged in a corresponding hole of the conductor and to cooperate with a nut for connecting the conductor with the support piece, characterized in that an annular spacer of electrically conductive material is located on the conductor, on the side of the conductor that faces support piece, and in that the nut is positioned on the opposite side of the conductor, wherein the nut is joined to the spacer by a coupling which allows rotation of the nut relative to the spacer, wherein the coupling provides the nut with a determined limited course of movement of nut relative to the spacer between a first position and a second position, and wherein the coupling facilitates the positioning and then the subsequent fastening of the nut with the threaded pin, further characterized in that the spacer has, on its side that faces the conductor, a receiving groove for the conductor, allowing a determined course of transverse movement for the spacer and the nut relative to the conductor in order to facilitate its centering on the threaded pin.

7. The system according to claim 1, further characterized in that the support piece has a reinforcement piece at the level of the threaded pin.

8. The system according to claim 1, further characterized in that the support piece is formed by another conductor.

9. The system according to claim 1, further characterized in that the support piece is formed by an electrical component.

* * * * *